US006191756B1

(12) United States Patent
Newham

(10) Patent No.: US 6,191,756 B1
(45) Date of Patent: Feb. 20, 2001

(54) BROAD BAND ANTENNAS

(75) Inventor: Paul Newham, Edgeward (GB)

(73) Assignee: Marconi Electronic Systems Limited (GB)

( * ) Notice: Under 35 U.S.C. 154(b), the term of this patent shall be extended for 0 days.

(21) Appl. No.: 09/450,056

(22) Filed: Nov. 29, 1999

(30) Foreign Application Priority Data

Jan. 15, 1999 (GB) ..... 9900765

(51) Int. Cl.[7] ..... H01Q 1/36
(52) U.S. Cl. ..... 343/895
(58) Field of Search ..... 343/895; H01Q 1/36

(56) References Cited

U.S. PATENT DOCUMENTS

| | | | | |
|---|---|---|---|---|
| 4,605,934 | * | 8/1986 | Andrews | 343/895 |
| 4,658,262 | | 4/1987 | DuHamel . | |
| 5,053,786 | | 10/1991 | Silverman . | |
| 5,146,234 | | 9/1992 | Lalezari . | |
| 5,227,807 | | 7/1993 | Bohlman et al. . | |
| 5,313,216 | | 5/1994 | Wang et al. . | |
| 5,517,206 | | 5/1996 | Boon et al. . | |
| 5,815,122 | | 9/1998 | Nornberger et al. . | |

FOREIGN PATENT DOCUMENTS

| | | |
|---|---|---|
| 0 198 578 A1 | 10/1986 | (EP) . |
| 0 825 674 A1 | 2/1998 | (EP) . |
| WO99/52178 | 10/1999 | (WO) . |

OTHER PUBLICATIONS

Reduced Size Spiral Antenna, T. E..,Morgan, Microwave 79, Sep. 17–20, 1979.

An Introduction to Wideband..,J. .A. Mosko, Microwave Journal, Feb. 1984, vol. 27, No. 2, pp. 91–92,96–106.

Reduced Size Spiral Antanna, T. E. Morgan, pp. 181–185, 9th European Microwave Conference 1979.

Microwave Journal, Feb. 1984, p. 91–106, An Introduction to Wideband Two–Channel Direction–Finding System, J. Mosko.

* cited by examiner

*Primary Examiner*—Michael C. Wimer
(74) *Attorney, Agent, or Firm*—Kirschstein, et al.

(57) ABSTRACT

The outer turns (3) of a spiral antenna are radially modulated to extend the low-frequency response. The modulation amplitude increases progressively with spiral angle. The unmodulated region may consist of equally-spaced inner turns (1), and outer turns (2) whose spacing increases with angle. The track width of the outer turns may progressively decrease. Alternatively the track width of the outer unmodulated region may increase, the width of the modulated turns then progressively decreasing. Corresponding modulation may be applied to the outer ends of the arms of sinuous antennas.

13 Claims, 3 Drawing Sheets

BROAD BAND ANTENNAS

BACKGROUND OF THE INVENTION

This invention relates to broadband antennas. It particularly relates to spiral and sinuous antennas of reduced size relative to conventional spiral and sinuous antennas of corresponding bandwidth.

The cavity backed spiral antenna has been used for a number of years as a means of providing circularly polarized radiation over a broad frequency band. The two most popular configurations are the dual arm equiangular and the Archimedean spirals, in which the two arms are fed in antiphase at the center. In both cases the radiating mechanism is the same and the radiation takes place from a region centred on one wavelength in circumference. Clearly, the lowest frequency of operation is determined by the diameter of the spiral, where the outer circumference is equal to the longest wavelength. If space is at a premium, then a square Archimedean configuration may be used to gain an aperture reduction in the ratio of $\pi$:4. Further aperture reduction is accomplished, as taught by Morgan in Proc. $9^{th}$ European Microwave Conf. September. 1979, pages 181–185, by forming a square spiral with a zigzag track to produce a slow wave structure. However, this approach limits the bandwidth of operation by reducing the resolution of the central region of the spiral, owing to the square characteristics of the geometry. This, combined with the zigzag modulation, results in an ill-defined geometry at the center of the spiral and limits the upper frequency of operation.

"An Introduction to Wideband Two-Channel Direction-finding System" (Microwave Journal, February 1984 pages 91–106, J. A. Mosko) describes an attempt to increase the effective aperture size using a four-arm spiral having sinusoidally-modulated filaments. This was said to have resulted in fairly poor success.

Other attempts to produce dual polarization antennas are disclosed in U.S. Pat. No. 5,227,807. These feature the provision of one or more pairs of quasi-spiral antennas of opposite hand arranged adjacent each other, the spirals being distorted to fit the or all pairs of spirals into a single circular footprint. The quasi-spirals are based on prototype spirals, each having an archemedian inner region and a logarithmic outer region, and one disclosed arrangement has sinuous outer turns to enable the spirals to be packed into the semi-circular areas more efficiently. This proposal uses an abrupt transition between the inner smooth quasi-spiral and the outer modulated spiral.

The sinuous antenna, as taught by DuHamel in European Patent EP-A-0198578, is an alternative form of cavity backed broadband printed antenna which has similar performance to the conventional spiral antenna, but is also capable of dual polarization. The four-arm sinuous antenna has generally sinuous arms extending outwardly from a common point and arranged at intervals of 90° about the central axis. Each antenna arm comprises cells of bends and curves, each cell being interleaved without touching between adjacent cells of an adjacent arm. In its more popular configuration, opposite arms are fed in antiphase, and the phase relationship between orthogonal pairs of arms can be chosen to be either 0° for linear polarization, +/−90° for opposite senses of circular polarization, or some arbitrary angle for elliptical polarization. The mechanism of operation is similar to the conventional spiral. Briefly, a single cell, comprising a pair of bends, will radiate if it is approximately one half wavelength in electrical length. The angular width of a single cell is typically about 90°. Thus the active radiating region at a given frequency will be about one wavelength in circumference. This means that for a minimum frequency of operation, the conventional spiral and the sinuous antenna are of approximately equal size.

SUMMARY OF THE INVENTION

It is an object of the present invention to provide improved broadband antennas.

A first aspect of the invention provides a spiral antenna comprising a plurality of spiral arms, said antenna comprising a radially inner region, a radially intermediate region, and a radially outer region, the turns of each said spiral arm being unmodulated in said inner and intermediate regions and radially modulated in said outer region, the trace of the spiral of each said spiral arm in said inner region having different parameters from the trace of the spiral of the same spiral arm in said intermediate region; in which the amplitude of modulation increases progressively with angle from substantially zero at the junction between said inner and outer regions.

A second aspect of the invention provides a sinuous antenna comprising a plurality of sinuous arms, the antenna comprising a radially inner region and a radially outer region, each said sinuous arm being unmodulated in said inner region and radially modulated in said outer region, in which the amplitude of modulation in said outer region increases progressively with radial distance from substantially zero at the junction between said inner and said outer regions.

BRIEF DESCRIPTION OF THE DRAWINGS

Embodiments of the invention will now be described by way of non-limiting example only with reference to the drawings in which.

DETAILED DESCRIPTION OF THE PREFERRED EMBODIMENTS

Before describing the embodiments, a few words of explanation are appropriate.

Figure 1:
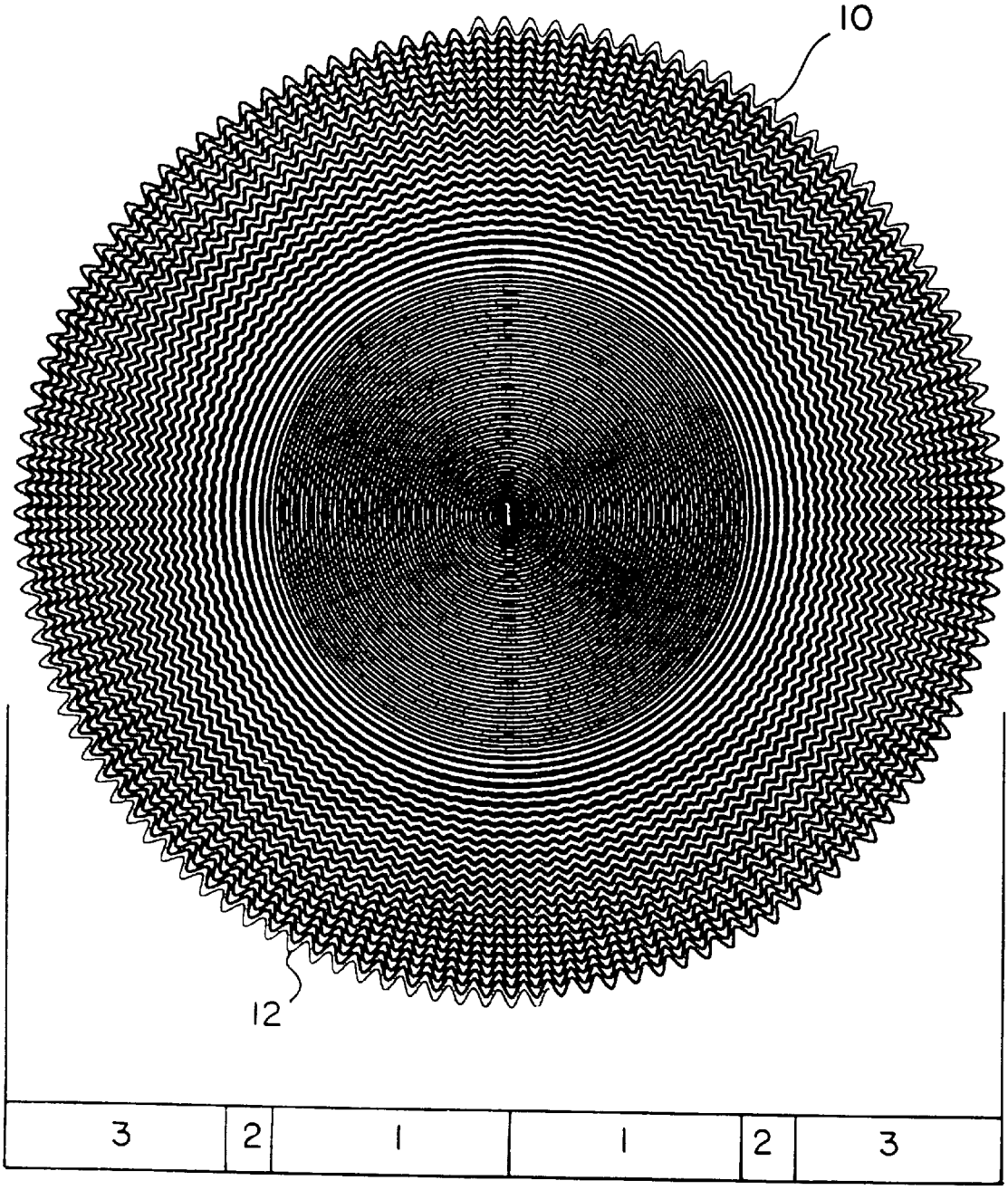
FIG. 1 shows a first embodiment of the invention.
Figure 3:
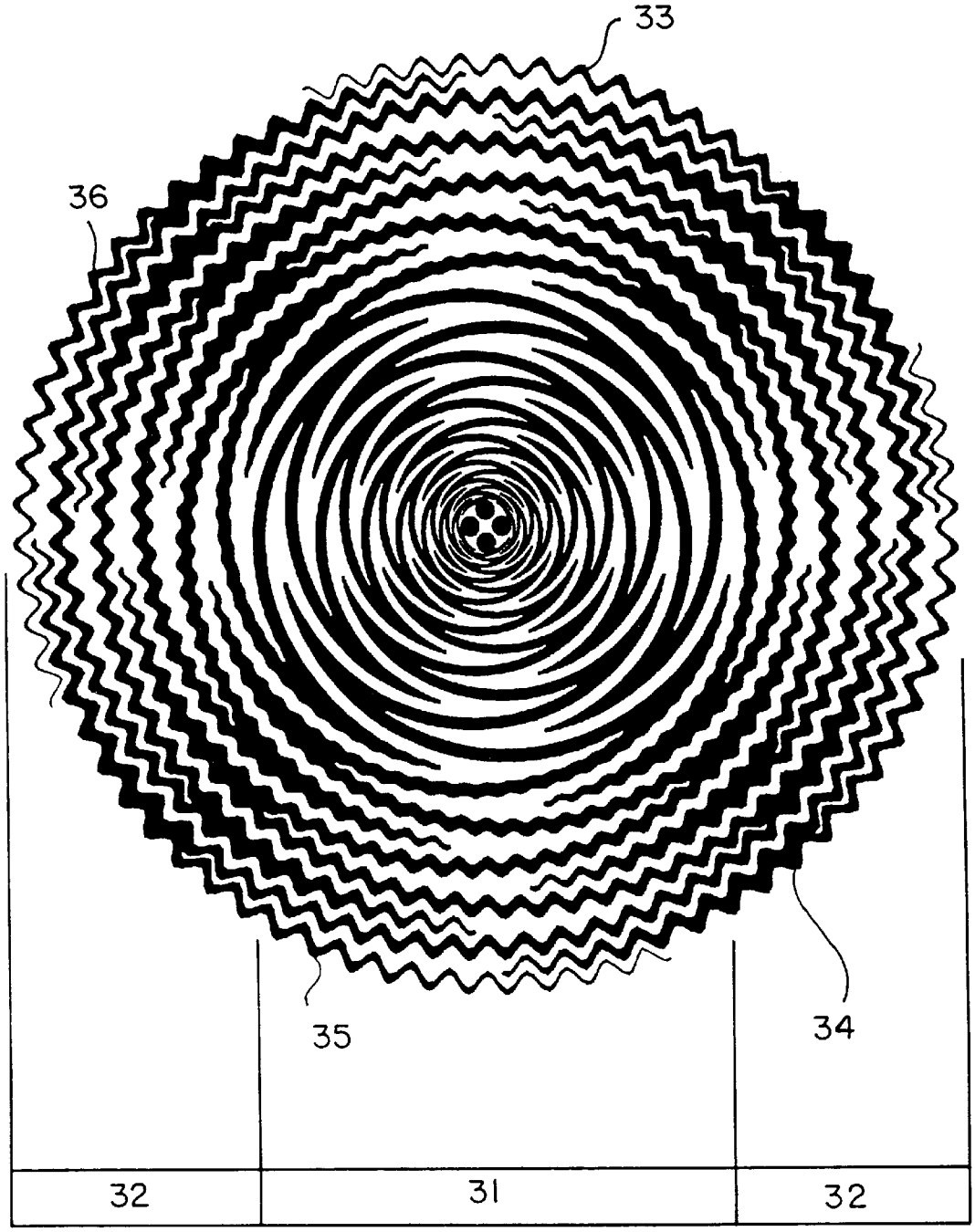
FIG. 3 shows a third embodiment of the invention.

To avoid obscuring the drawing with lead lines, FIGS. 1 and 3 include respective "ruler" bearing the appropriate reference numerals which identify the various radial regions. The center of the ruler is to be notionally superposed on the center of its associated antenna.

Reference is made to parameters which are a function of radial distance. As the structures concerned are of spiral form, this is of course another way of saying that the parameters vary as a function of the angle of the spiral or prototype spiral.

Referring now to FIG. 1, a two-arm center-fed spiral antenna has an inner region 1 in which the spiral arms 10, 12 are generally of archemedian configuration, i.e. equally spaced. The turns are of uniform radial width in this region. Adjacent inner region 1 is an intermediate region 2 in which the spiral arms are no longer equally spaced, but have a spacing which progressively increases with radial distance. If we consider the middle of the width of the arms to be the locus of respective prototype spirals, the portions of the spirals lying withing the inner region can be considered to have different formulae from the portions lying within the intermediate region. The radial thickness of the arms increases also. Adjacent intermediate region 2 is an outer region 3 in which the arms are radially modulated. The modulation amplitude progressively increases with radial distance from zero at the boundary between the intermediate region 2 and outer region 3. Again considering the middle of the width of the modulated arms to be modulated versions of prototype spirals whose respective locii follow the radial middle of the width of the arms, the distance between adjacent turns of the prototype spiral is constant. To ensure that adjacent turns never touch, the radial width of the turns progressively decreases with radial distance of the prototype spiral.

In the present embodiment the rate of growth of amplitude of modulation is a linear function of spiral growth such that, at the periphery of the spiral, the increase of path length of one cycle of the sinusoid over the prototype equivalent unmodulated track, results in an increase in electrical path length by the same ratio, thus effectively increasing the electrical circumference of the spiral. The distance between adjacent turns remains approximately constant, despite the increasing track modulation amplitude. This results in an increase in the length of the longest wavelength at which the spiral will resonate, thereby extending the lowest frequency of operation by the ratio of the increased path length to the prototype path length at the periphery.

It is to be noted that, in the outer region 3, the active region at a given frequency will shrink to a smaller diameter compared with the prototype spiral. Hence the corresponding beamwidth will increase relative to a conventional spiral, with a corresponding reduction in gain.

In a modification, not shown, the modulation amplitude of the spiral in the outer region grows at an exponential rate. Other growth rates, e.g. hyperbolic, with respect to angle or radial distance are possible.

In a further modification, not shown, the distance between adjacent turns of the prototype spiral increases with radial distance. This allows the radial width of the turns to remain constant while still maintaining a constant distance between adjacent turns despite the progressive increase in modulation amplitude.

Figure 2:
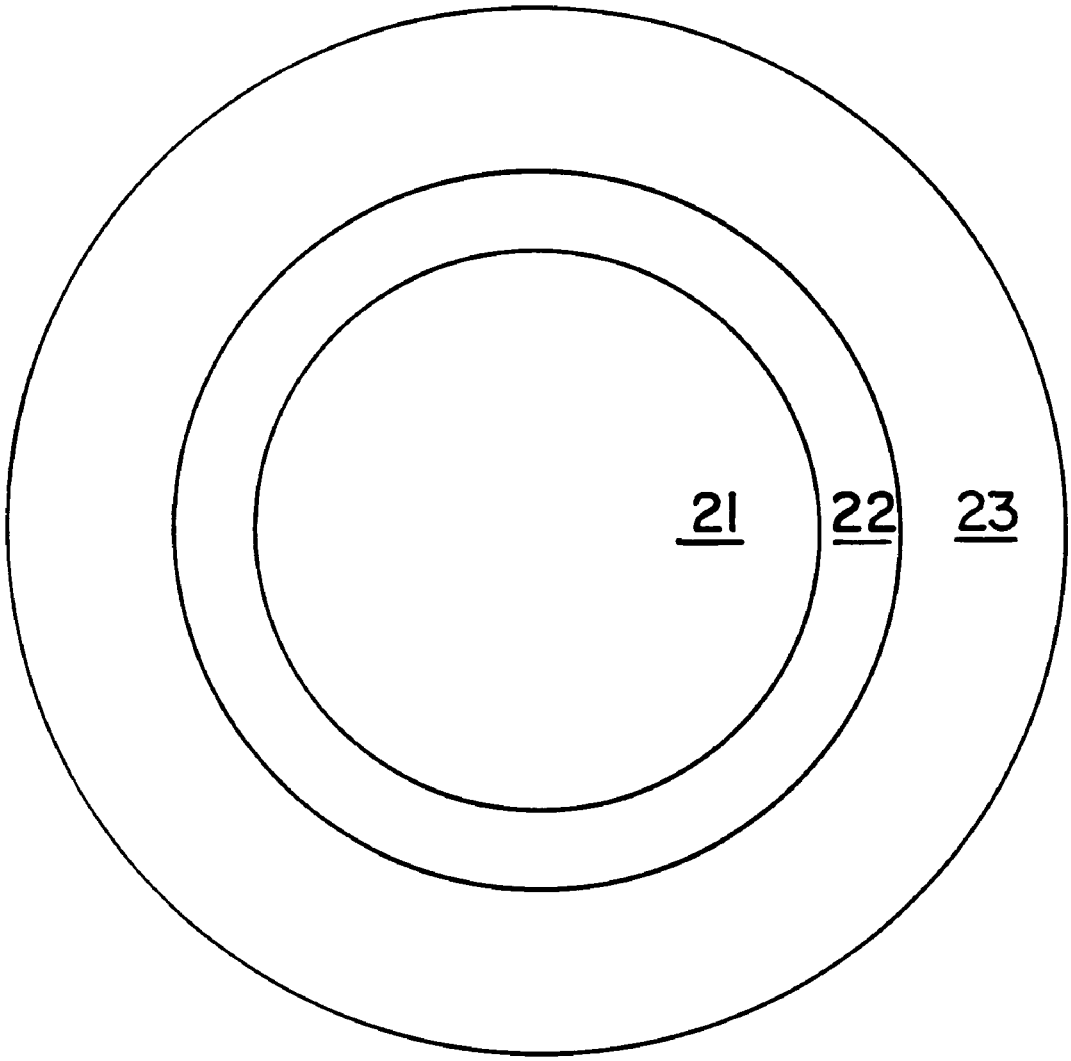
FIG. 2 shows a second embodiment of the invention.

FIG. 2 shows a second embodiment of a spiral arm antenna. In this figure the two spiral arms themselves have been omitted, the figure merely identifying the regions in which the properties of the spiral differ.

In the inner region 21 the spiral arms are of archemedian form and are center fed as for the first embodiment.

In the intermediate region 22 the spiral remains unmodulated, but its radial width decreases with increasing radial distance. The pitch of the prototype spiral remains the same as for the inner region, and thus the distance between the edges of adjacent turns progressively increases with radial distance.

In the outer region 23 the turns of the spiral are of constant width equal to the width of the spiral of the middle region at its junction with the outer region. The turns of the spiral in the outer region are radially modulated with modulation amplitude increasing with radial distance from zero at the junction with the middle region.

FIG. 3 shows a sinuous antenna having four arms 33, 34, 35, 36. In a radially inner region 31 the sinuous arms are unmodulated. In a radially outer region 32 sinusoidal modulation is applied to each sinuous arm. The amplitude of the modulation is allowed to grow at a predetermined rate, growth commencing from zero at an arbitrary radius defining the boundary between regions 31 and 32, and reaching a maximum amplitude at the antenna periphery. In the present embodiment the rate is linear. The modulations provide an electrically increased path length for each cell in region 32, which effectively enables the antenna to radiate at a lower frequency than would be the case if no modulations were provided. As with the spiral antenna, the maximum modulation amplitude at the antenna periphery determines by how much the lower frequency of operation is extended relative to a conventional sinuous antenna of the same size. The modulated sinuous antenna of FIG. 3 has a diameter of 50 mm which, in its original form, would operate over 2–18GHz. There are 72 modulation cycles applied, with a maximum amplitude of 0.5 mm The electrical length of the outer cell of each sinuous arm has therefore been increased by a factor of 1.4, which implies that the lowest frequency of operation has been reduced to 1.43GHz. However, it should also be noted that the size of the cavity will affect this lower value due to cutoff conditions.

In a modification, not shown, the modulation increases at an exponential rate. Any other suitable rate, e.g., hyperbolic, may be employed according to design preferences.

A number of further modifications are possible within the scope of the invention. While the spiral antennas described have two arms, any number of arms may be employed. Similar comments apply to the sinuous antennas.

Wang and Tripp, in their U.S. Pat. No. 5,313,216, teach us that spiral-type antennas need not be backed by an absorbing cavity. Indeed, they only require a ground plane, separated from the printed spiral, or sinuous track surface by a short distance, typically about 3 mm. The performance is similar to standard cavity backed spiral antennas in both pattern shape and bandwidth, except that the gain is effectively doubled due to the absence of any absorber, and the utilization of the rearward directed radiation in reinforcement of the forward directed radiation. Sinusoidal track modulation can also be applied to this so-called Spiral Mode Microstrip Antenna. The absence of a cavity can enable size reduction to be accomplished without the cutoff limitations imposed by the reduced size of the cavity.

What is claimed is:

1. A spiral antenna, comprising: a plurality of spiral arms, a radially inner region, a radially intermediate region, and a radially outer region, each said spiral arm having turns unmodulated in said inner and intermediate regions and radially modulated in said outer region, each said spiral arm having a spiral trace in said inner region having different parameters from the spiral trace of the same spiral arm in said intermediate region; in which an amplitude of modulation increases progressively with angle from substantially zero at a junction between said inner and outer regions.

2. An antenna as claimed in claim 1 in which said arms are based on archimedean spirals in said inner and intermediate regions.

3. An antenna as claimed in claim 1 in which said amplitude of modulation increases as a function of angle.

4. An antenna as claimed in claim 3 in which said amplitude of modulation increases linearly with angle.

5. An antenna as claimed in claim 3 in which said amplitude of modulation increases exponentially with angle.

6. An antenna as claimed in claim 1 in which a locus of a midpoint of a track of each said spiral arm in said inner region has a different formula from that of the track of the same said spiral arm in said intermediate region.

7. An antenna as claimed in claim 1 in which, in said intermediate region, a spacing between adjacent edges of said spiral arms increases progressively with radial distance.

8. An antenna as claimed in claim 1 in which, in said intermediate region, a respective radial width of each said spiral arm increases progressively with radial distance from a minimum to a maximum width.

9. An antenna as claimed in claim 8 in which the turns of said inner region are of uniform width substantially equal to said minimum width.

10. An antenna as claimed in claim 8 in which the width of the turns of said outer region is equal to said maximum width at the junction with said intermediate region, at least part of said outer region comprising turns whose width progressively decreases with increasing modulation amplitude.

11. An antenna as claimed in claim 1 in which said intermediate region comprises turns whose radial width decreases progressively with radial distance from a maximum width to a minimum width.

12. An antenna as claimed in claim 11 in which the turns of said inner region are of uniform width substantially equal to said maximum width.

13. A sinuous antenna, comprising: a plurality of sinuous arms, a radially inner region and a radially outer region, each said sinuous arm being unmodulated in said inner region and radially modulated in said outer region, in which an amplitude of modulation in said outer region increases progressively with radial distance from substantially zero at a junction between said inner and said outer regions.

* * * * *